United States Patent [19]

Smith

[11] Patent Number: 4,663,626

[45] Date of Patent: May 5, 1987

[54] REMOTE CONTROL VEHICLE UNLOCKING DEVICE

[76] Inventor: Eldon L. Smith, 59050 Elm Rd., Mishawaka, Ind. 46544

[21] Appl. No.: 786,320

[22] Filed: Oct. 10, 1985

Related U.S. Application Data

[63] Continuation-in-part of Ser. No. 722,079, Apr. 11, 1985, abandoned.

[51] Int. Cl.[4] ..... G08C 13/00

[52] U.S. Cl. ..... 340/825.69; 340/825.72; 70/256

[58] Field of Search ..... 361/171, 172; 307/9, 307/10 R, 10 AT, 247 R, 48 D; 340/543, 572, 825.31, 825.34, 825.69, 825.72, 539, 696; 49/25; 70/256, 257; 377/15

[56] References Cited

U.S. PATENT DOCUMENTS

| | | | |
|---|---|---|---|
| 3,122,721 | 2/1964 | Liu et al. | 340/825.69 X |
| 3,461,313 | 8/1969 | Hansen | 307/247 R X |
| 3,506,956 | 4/1970 | Kolm et al. | 340/825.72 X |
| 3,858,116 | 12/1974 | Friedl et al. | 340/625.69 X |
| 3,937,976 | 2/1976 | McGuirk, Jr. | 307/10 AT |
| 4,143,368 | 3/1979 | Route et al. | 340/543 |
| 4,197,524 | 4/1980 | Salem | 340/543 X |
| 4,236,594 | 12/1980 | Ramsperger | 307/10 AT X |
| 4,405,924 | 9/1983 | Shinoda et al. | 340/825.72 |
| 4,413,261 | 11/1983 | Greenberg | 307/10 AT X |

*Primary Examiner*—Ulysses Weldon

*Attorney, Agent, or Firm*—Thomas J. Dodd

[57] ABSTRACT

Apparatus for actuating a vehicle power assist member from outside the vehicle, the vehicle power assist member including actuating means located inside the vehicle, the apparatus comprising a transmitter means which includes an incorporated switch, the transmitter means for emitting a single radio wave pulse upon actuation of the switch, means electrically coupled to the power assist member actuation means for receiving the radio wave pulse from the transmitter means upon activation of the transmitter means and converting the radio wave pulse into electric current wherein the power assist member actuation means is activated.

4 Claims, 3 Drawing Figures

REMOTE CONTROL VEHICLE UNLOCKING DEVICE

CROSS-REFERENCE TO RELATED APPLICATIONS

This application is a continuation-in-part of application Ser. No. 722,079, filed Apr. 11, 1985, now abandoned.

SUMMARY OF THE INVENTION

This invention relates to an automatic unlocking device and will have special application to a sound or radio wave-controlled device for locking and unlocking vehicle doors and trunk lids.

Various automatic devices for locking and unlocking doors have been introduced. Most common are the automatic garage door openers which utilize a portable transmitter for sending signals to a receiver unit which activates a motor attached to the garage door. Other such devices include security unlocking systems which involve the use of two or more coded transmitters. The coded transmitters interact with a door circuit to automatically open the door as the correct frequency is received. Examples of coded devices are seen in U.S. Pat. Nos. 3,196,440 and 3,891,980. The drawbacks of these devices are the ease with which an unauthorized person can open the door while carrying a transmitter of the correct frequency, and the complex circuitry required for the operation of the system.

The unlocking device of this invention includes a portable, hand-activated radio transmitter and a receiver/transmitter/signal converter unit connected to the power door locking circuit of a vehicle. When the transmitter is activated by depressing a switch, the vehicle doors are locked. The signal converter may also be connected to the power trunk lid opener or other power assist device of an automobile to open the trunk lid or activate the power assist when the transmitter is activated. This device is extremely convenient after shopping and during periods of inclement weather.

Accordingly, it is an object of this invention to provide for a novel remote control locking/unlocking device.

Another object of this invention is to provide for a wave-controlled unlocking device which is for a vehicle power door lock or power trunk lid.

Another object of this invention is to provide for a wave-controlled unlocking device which is efficient, simple to install, and economical.

Another object of this invention is to provide a hand-operated remote control unlocking device which is for a vehicle power door lock or power trunk lid.

Other objects of this invention will become apparent upon a reading of the following description.

DESCRIPTION OF THE PREFERRED EMBODIMENT

Figure 1:
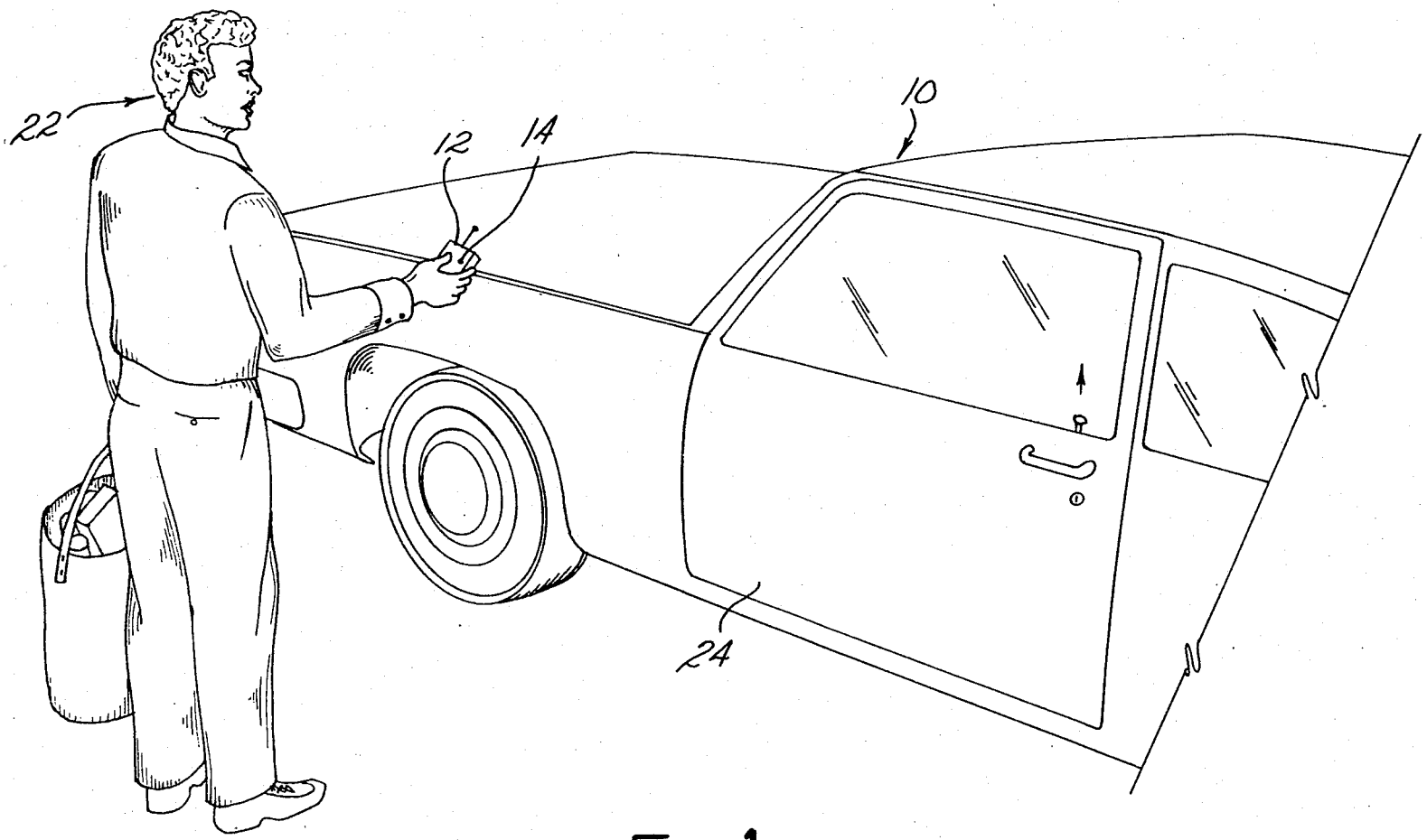
FIG. 1 is a fragmentary perspective view of an automobile depicting the unlocking device of this invention.

The preferred embodiment herein described is not intended to be exhaustive or to limit the invention to the precise form disclosed. It is chosen and described to explain the principles of the invention and its application and practical use to enable others skilled in the art to utilize the invention.

The unlocking device of this invention is generally adapted to be used in conjunction with a vehicle, such as automobile 10 which has a power door unlocking relay 94, a power trunk lid relay 100, and other power articles, such as automatic dome lights, horns, radios, etc. For ease of description, device 8 will be described as if it were connected to the door unlocking device 18 and the trunk lid opener 20.

Figure 2A:
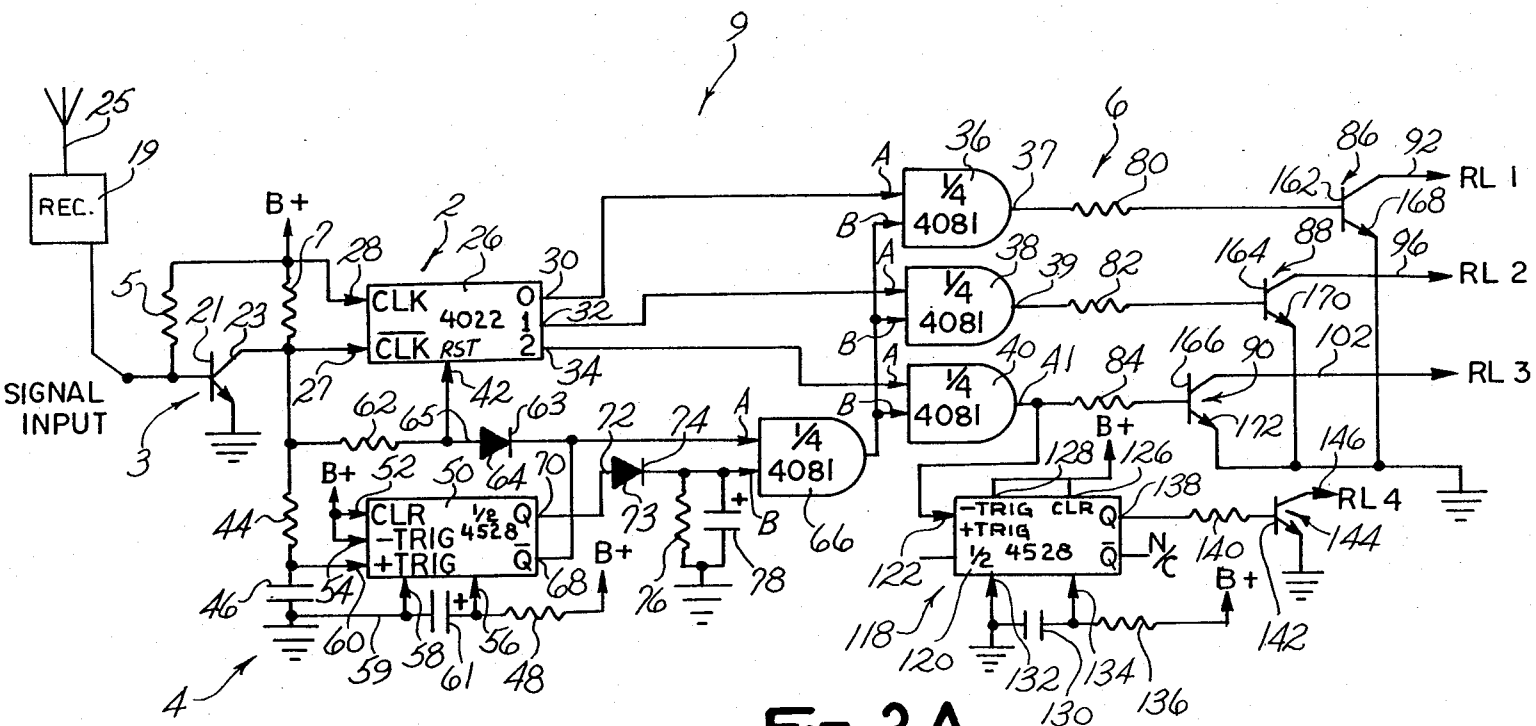
FIG. 2A is a diagrammatical representation of the component parts of the unlocking device.
Figure 2B:
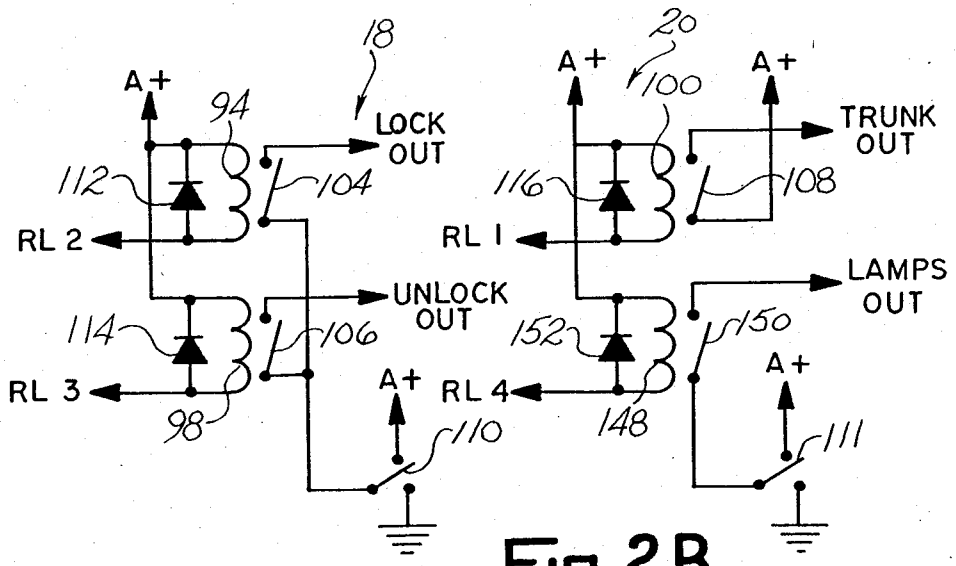
FIG. 2B is a diagrammatical representation of the automobile power relays.

Remote lock control 9 shown in FIG. 2A in schematic form includes a counter circuit 2 and timing circuits 4. The output of counter circuit 2 drives relay circuit 6. A voltage regulating circuit (not shown) provides a constant and regulated voltage level to the above circuits.

Counting circuit 2 includes NPN transistor 3 connected in a common emitter configuration. Resistors 5 and 7 provide the proper D.C. biasing current to transistor 3, whose base 21 is connected to the output of receiver 19 shown in FIG. 2A in block form. Collector 23 of transistor 3 is connected to "not clock" input 27 of walking ring counter 26. The "clock" input 28 of counter 26 is connected to a regulated power supply B+ and outputs 30, 32, 34 are connected to input A of each AND gate 36, 38, 40 respectively. Reset input 42 of counter 26 is connected to timing circuit 4.

Timing Circuit 4 includes programmable timer 50 with clear input 52 and "− triggering" input 54 connected to regulated power supply B+. Current limiting resistor 48 is connected between supply B+ and programming input 56. Timing capacitor 61 is connected between timer programming inputs 56 and 58. Programming input 58 is connected to ground by lead 59. Capacitor 46 is connected between "+ triggering" input 60 and ground. Resistor 44 is connected between collector 23 of transistor 3 and capacitor 46. Current limiting resistor 62 is connected between reset input 42 and transistor collector 23. Diode 64 is connected at its anode 65 to reset 42 and at its cathode 63 to input A of AND gate 66. "Q not" output 68 of timer 50 is connected to cathode 63 of diode 64. "Q" output 70 of timer 50 is connected to the anode 72 of diode 73. Diode 73 has its cathode 74 connected to input B of AND gate 66. The parallel combination of resistor 76 and capacitor 78 is connected between input B of AND gate 66 and the cathode 74 of diode 73. The output of AND gate 66 is connected to the B inputs of AND gates 36, 38, and 40. Outputs 37, 39, and 41 of AND gates 36, 38 and 40 are connected to relay circuits 6.

Relay circuits 6 include current limiting resistors 80, 82, 84 connected respectively between the outputs of AND gates 36, 38, 40 and bases 162, 164, and 166 of current sinking NPN transistors 86, 88, 90. Emitters 168, 170, and 172 of transistors 86, 88, 90 are connected to ground. Relay coil 94 is connected between an unregulated power supply A+ (from the vehicle battery) and collector 96 of transistor 88. Similarly, relay coil 98 is connected between supply A+ and collector 102 of transistor 90 and relay coil 100 is connected between supply A+ and collector 92 of transistor 86. Contactor 104 of relay 94 is connected between a conventional vehicle power lock relay (not shown) and switch 110. Similarly, contactor 106 of relay 98 is connected between a conventional vehicle power unlock relay (not shown) and switch 110. Contactor 108 is connected between a conventional vehicle trunk unlock relay (not shown) and switch 111. Diodes 112, 114, and 116 respectively are connected across relay coils 94, 98, and 100 with their cathodes connected to unregulated power supply side of coils 94, 98, and 100.

Light timing circuit 118 includes programmable timer 120 with "+ triggering" input 122 connected to output 41 of AND gate 40. Clear input 126 and "− triggering" input 128 are connected to regulated positive power supply B+. Timing capacitor 130 is connected between programming inputs 132 and 134. Resistor 136 is connected between programming input 134 and regulated power supply B+. Current limiting resistor 140 is connected between "Q" output 138 of timer 120 and base 142 of transistor 144. Transistor 144 is wired in a common emitter configuration with relay coil 148 connected between unregulated power supply A+ and collector 146. Relay contactor 150 is connected between the internal automobile lights (not shown) and master switch 111. Diode 152 is connected across relay coil 148 with its cathode connected to the unregulated power supply side of coil 148.

In operation, remote lock control 10 functions in the following manner. Note that the discussion will not concern itself with the transmission or reception of the radio signal used to initiate the controls operation as any method which will produce a single radio wave pulse at the receiver output may be implemented.

Initially, transistor 3 is properly biased by resistors 5 and 7. Walking ring counter 26 is producing a high logic level at output 30 which appears at input A of AND gate 36. There is no input voltage at input B of AND gate 36 at this time; therefore there is no output at 37. When the user desires to lock his automobile he presses a button 14 on the transmitter 12 to send a single radio wave pulse to receiver 19 (which may include antenna 25) and to transistor 3. Transistor 3 inverts the input and places the inverted input at "not clock" input 27 of timer 26. Simultaneously, the inverted input also appears at input 42 which resets counter 26 thereby placing a high logic level at output 30. The inverted input also triggers timer 50. The timing constant created by resistor 44 and capacitor 46 determines the length of the reset and triggering pulse, typically 1 millisecond. After timer 50 is triggered "Q not" output 68 goes to a low logic level thereby removing the signal at input 42 through diode 64 and preventing any further reset of counter 26 to occur so long as timer 50 is active. When "Q not" output 68 goes low "Q" output 70 changes to a high logic level thereby charging capacitor 78 through diode 73. The time constant of timer 50 is determined by capacitor 61 and resistor 48 and is typically 500 milliseconds. (0.5 sec.) Timer 50 is retriggerable, that is, another time constant is started if another pulse is sent by depression of the transmitter button 14 before-the-end of the time constant. This allows the user to enter multiple key depressions to select the desired functions of lock control 9. When the user releases the button on the transmitter the input at transistor base 21 will go low which results in a high at input 27. Counter 26 will advance on the falling edge of the input signal to produce a high at output 32.

If an input has not been received during the time constant, "Q not" output 68 returns to a high logic level and "Q" output 70 returns to a low logic level. "Q" output 70 returns to low to allow capacitor 78 to begin to discharge at a rate determined by resistor 76 and capacitor 78. With capacitor 78 discharging and "Q not" output 68 high, AND gate 66 produces a high logic level to appear at the B inputs of AND gates 36, 38, and 40. Assuming that the user wished to lock his vehicle, output 32 of counter 26 will be high thereby producing a high level at input A of AND gate 38. With both inputs A and B of gate 38 at a high logic level AND gate output 39 goes high thereby forward biasing the base to emitter junction of transistor 88. When transistor 88 is forward biased, current begins to flow through relay coil 94 and collector 96 to ground from unregulated power supply A+. Current through relay coil 94 produces a magnetic flux thereby closing contactor 104 which in turn will energize the automobile locking relay (not shown) to lock the doors. After a time (determined by resistor 76 and capacitor 78) capacitor 78 will be fully discharged thereby removing the high level at input B of AND gate 66 causing the output of gate 66 to go low. This low logic level will appear at the B inputs of AND gates 36, 38, 40. A low level at input B of AND gate 38 causes output 38 to go low thereby turning transistor 88 off. With transistor 88 off current ceases to flow through coil 94 thereby allowing contactor 104 to open.

To unlock the automobile and turn on the interior lights the user presses transmitter button 14 twice within the time constant outlined above (0.5 seconds) thereby resetting ring counter 26 and timer 50 as described earlier. However, since the remote key has been pressed twice the output of ring counter 26 is now shifted to output 34. Recalling the previous explanation, a high input from AND gate 66 now appears at input B of AND Gate 40 and input A of AND gate 40 has a high input value from output 34. AND gate 40 produces a high output at 41 which turns on transistor 90 which in turn forms a current path through coil 98. Magnetic flux is created around coil 98 when current is flowing to close contactor 106 and provide voltage to the automobile unlocking relay (not shown). Simultaneously, with transistor 90 being turned on, the high level at output 41 triggers timer 120. Timer 120 produces a high logic level at "Q" output 138 which forward biases the base to emitter junction of transistor 144. When the base to emitter junction is forward biased, transistor 144 begins to sink current from unregulated supply A+ through coil 148 to close contactor 150 and turn on the vehicle interior lights. The time constant achieved by resistor 136 and capacitor 130 (typically between 15–20 seconds) causes the vehicle interior lights to remain lighted for this period of time.

To unlock the trunk of the automobile the user presses the transmitter button 14 and holds it for a short period of time until the trunk opens; therefore the sequence of operation is slightly different than previously described sequences. When the user holds the transmitter button 14 down (for about 3–4 seconds) the input signal at transistor base 21 is high and will remain high until the user releases the button. A high level on base 21 causes a low level at input 27 and reset input 42 and "+ triggering" input 60 which resets counter 26 to zero and triggers timer 50. When timer 50 "times out" as determined by capacitor 61 and resistor 48, "A" output of timer 50 goes high as described earlier. Walking ring counter 26, as described earlier, advances on the trailing edge of the input signal, however, in this situation since there is no trailing edge, the counter does not advance and therefore when timer 50 times out, the output of counter 26 is still at output 30. The sequence of operation from this point on follows the sequences described earlier of energizing coil 100 which thereby closes contactor 108 for a predetermined amount of time as determined by capacitor 78 and resistor 76 to unlock the vehicle trunk lid.

The pulse signals sent by transmitter 12 may be digitally coded by any conventional method. One such digital coding method is shown in U.S. Pat. No. 4,143,368. The advantages of digital coding are even more advantageous with the unlocking system of this invention in the prevention of unauthorized entry. Due to the need for creation of two like pulses within 0.5 second time frame, it is highly unlikely that an individual will be able to unlock the vehicle doors 24 even if possessed of a digital code and pulse generator.

Alternatively, receiver 19 may be adapted to receive sound waves from a human voice. The sound waves are converted into electric current by receiver 19 and transmitted to power door unlocking device 94 or power trunk lid opener 100 of the vehicle 9 as in the previous embodiment.

It is to be understood that this description does not limit the invention to this form, and that it may be modified within the scope of the appended claims.

I claim:

1. Apparatus for actuating a vehicle power assist member from outside the vehicle, said vehicle power assist member including actuating means located inside the vehicle, said apparatus comprising a transmitter means which includes an incorporated switch, said transmitter means for emitting a single radio wave pulse upon actuation of said switch, means electrically coupled to said power assist member actuation means for receiving said radio wave pulse from said transmitter means upon activation of said transmitter means and converting the radio wave pulse into electric current wherein said power assist member actuation means is activated, said power assist actuation means including a locking relay and an unlocking relay, selective latching means responsive to a first emission of said radio wave pulse, said latching means having a first output connected to one of said locking and unlocking relays for actuation thereof upon reception of said first emitted radio wave pulse, said latching means responsive to a second emission of said radio wave pulse when received within a specific time after said first emitted pulse and having a second output connected to the other of said locking and unlocking relays, said second output constituting means for activating the other of said locking and unlocking relays upon reception of said second emitted radio pulse, said latching means including a walking ring counter having an input connected to said receiving means, timer means having an input connected to said counter for regulating said first and second latching means outputs, and a plurality of AND gates each having inputs connected to one of said counter outputs and said timer means, each AND gate having an output connected to one of said locking and unlocking relays.

2. Apparatus of claim 1 wherein said power assist member is a power door lock.

3. Apparatus of claim 1 wherein said power assist member is a power trunk lid opener.

4. Apparatus of claim 1 and triggering means connected between said unlocking relay and vehicle interior lights, said triggering means for activating said vehicle interior lights upon actuation of said unlocking relay, and a second timer means for activating the lights for a certain period of time upon actuation of said triggering means.

* * * * *